US007624710B2

(12) United States Patent
Uehama et al.

(10) Patent No.: US 7,624,710 B2
(45) Date of Patent: Dec. 1, 2009

(54) VALVE TIMING CONTROLLER

(75) Inventors: Motoki Uehama, Kariya (JP); Yasushi Morii, Nagoya (JP)

(73) Assignee: Denso Corporation, Kariya (JP)

( * ) Notice: Subject to any disclaimer, the term of this patent is extended or adjusted under 35 U.S.C. 154(b) by 242 days.

(21) Appl. No.: 11/905,848

(22) Filed: Oct. 4, 2007

(65) Prior Publication Data

US 2008/0083388 A1 Apr. 10, 2008

(30) Foreign Application Priority Data

Oct. 6, 2006 (JP) ..... 2006-275512

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160; 475/331, 338
See application file for complete search history.

(56) References Cited

U.S. PATENT DOCUMENTS 637,389 A 11/1899 Hertz
3,978,829 A 9/1976 Takahashi et al.
5,327,859 A * 7/1994 Pierik et al. ..... 123/90.17
2004/0206322 A1 10/2004 Meintschel et al.
2005/0145049 A1 7/2005 Axmacher et al.
2005/0199201 A1 9/2005 Schafer et al.

FOREIGN PATENT DOCUMENTS

DE 41 10 195 10/1992

* cited by examiner

*Primary Examiner*—Ching Chang
(74) *Attorney, Agent, or Firm*—Nixon & Vanderhye, PC

(57) ABSTRACT

A valve timing controller includes a first rotor having a first gear, a second rotor having a second gear, and a planet gear engaged with the first and the second gear. The first rotor has the support opening and accommodates the second rotor therein. The second rotor has the supporting spindle part which supports the support opening from its inner circumference. The support opening and the supporting spindle part are formed in a minor diameter rather than the second gear which engages the planet gear with lubricant. The supporting opening and the supporting spindle part are positioned at a place which deviates from the second gear in an axial direction thereof.

7 Claims, 5 Drawing Sheets

VALVE TIMING CONTROLLER

CROSS-REFERENCE TO RELATED APPLICATION

This application is based on Japanese Patent Application No. 2006-275512 filed on Oct. 6, 2006, the disclosure of which is incorporated herein by reference.

FIELD OF THE INVENTION

The present invention relates to a valve timing controller which adjusts valve timing of an inlet valve and/or an exhaust valve of an internal combustion engine.

BACKGROUND OF THE INVENTION

In the valve timing controller shown in US-2004-0206322A1, a planet gear mechanism varies a relative rotational phase between two rotors which rotate along with a crankshaft and a camshaft, whereby the valve timing is adjusted.

In this kind of valve timing controller, a gear provided in each rotor is engaged with the planet gear. Since a large reduction ratio can be obtained by compact design, it becomes suitable as a valve timing controller attached to an internal combustion engine.

The rotor of a crankshaft and the rotor of a camshaft change the relative rotational phase therebetween by performing relative rotation, while engaging each gear with the planet gear. Therefore, in order to make smooth the phase change by the planetary motion of a planet gear, it is necessary to secure the relative position precision in diameter direction between rotors by supporting one of rotors from its inner circumference by the other.

In the above valve timing controller, the rotor of the crankshaft is supported by the rotor of the camshaft accommodated therein. However, since the supporting section exists in the outer circumference of the gear provided in the rotor of the camshaft, the following problems will arise. That is, when the lubricant is supplied to the engaging part of the gear and the planet gear, the lubricant flows into a supporting portion by a centrifugal force, so that the lubricant flows outside from there and lubrication is deteriorated.

The present invention is made in view of the above matters, and it is an object of the preset invention to provide an electric valve timing controller which realizes a smooth operation and a high durability.

SUMMARY OF THE INVENTION

According to the present invention, a valve timing controller includes a first rotor having a first gear, a second rotor having a second gear, and a planet gear performing a planetary motion to vary a relative rotational phase between the first rotor and the second rotor while engaging with the first gear and the second gear. The first rotor has the support opening and accommodates the second rotor therein. The second rotor has a supporting spindle part which supports the support opening from an inner circumference thereof. An inner diameter of the supporting opening and an outer diameter of the supporting spindle part are smaller than an outer diameter of the second gear which engages the planet gear with a lubricant. The supporting opening and the supporting spindle part are positioned at a place which deviates from the second gear in an axial direction thereof.

Since the supporting spindle part of the second rotor supports the support opening of the first rotor from the inner circumference, the relative position precision in the diameter direction between these rotors is securable. Therefore, the smooth phase change is realizable with the planetary motion of the planet gear which engaged to the first and the second gear of the first and the second rotor.

DETAILED DESCRIPTION OF THE PREFERRED EMBODIMENTS

Figure 1:
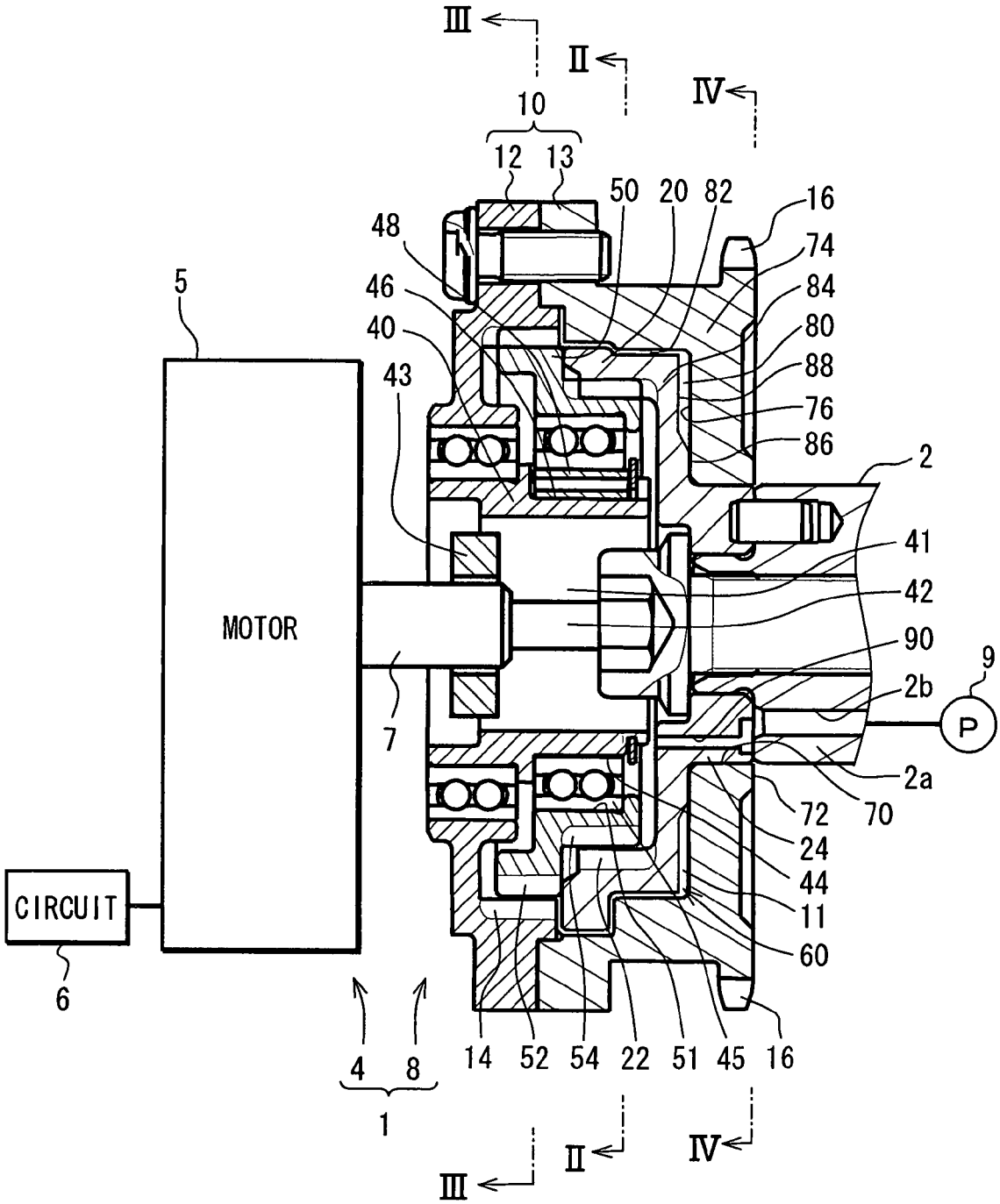
FIG. 1 is a cross sectional view showing a valve timing controller according to a first embodiment of the present invention, taken along a line I-I in FIG. 2.

Hereafter, embodiments of the present invention are described. In each embodiment, the same parts and the components are indicated with the same reference numeral and the same description will not be reiterated.

First Embodiment

FIG. 1 shows the valve timing controller 1 according to the first embodiment of the present invention. The valve timing controller 1 is provided in the transmission system which transmits engine torque to the camshaft 2 from the crankshaft (not shown) of the internal combustion engine. The valve timing controller 1 includes the torque generating system 4 and phase adjusting mechanism 8, and successively realizes valve timing suitable for an internal combustion engine by adjusting the relative rotational phase (henceforth an engine phase) of a camshaft 2 relative to a crankshaft. In the present embodiment, the camshaft 2 opens/closes the intake valve (not shown), and the valve timing controller 1 adjusts the valve timing of the intake valve.

First, the torque generating system 4 is explained. The torque generating system 4 is provided with an electric motor 5 and a control circuit 6.

The electric motor 5 is, for example, a brushless motor. When energized, the electric motor generates controlling torque on its motor shaft 7. The control circuit 6 includes a microcomputer and a motor driver, and is arranged in exterior and/or interior of the electric motor 5. The control circuit 6 is electrically connected with the electric motor 5 to control the energization of the electric motor 5 according to the operation condition of the internal combustion engine. In response to this controlled energization, the electric motor 5 holds or varies the torque applied to the revolving shaft 7.

Next, the phase adjusting mechanism 8 is explained hereinafter. The phase adjusting mechanism 8 is provided with the driving-side rotor 10, the driven-side rotor 20, the planetary carrier 40, and the planet gear 50.

The driving-side rotor 10 includes a gear member 12 and a sprocket 13 which are coaxially fixed together by a bolt. The driving-side rotor 10 has a chamber house 11 in which the driven-side rotor 20, the planetary carrier 40, and the planet gear 50 are accommodated. The peripheral wall of the gear member 12 forms the driving-side internal gear 14. The sprocket 13 has a plurality of gear teeth 16. A timing chain (not shown) is wound around the sprocket 13 and a plurality of teeth of the crankshaft so that the sprocket 13 is linked to the crankshaft. Therefore, when the engine torque outputted from the crankshaft is inputted into the sprocket 13 through the timing chain, the driving-side rotor 10 is rotates along with the crankshaft, while maintaining the relative rotational phase relative to the crankshaft. At this time, the driving side rotor 10 rotates counterclockwise in FIGS. 2 and 3.

Figure 2:
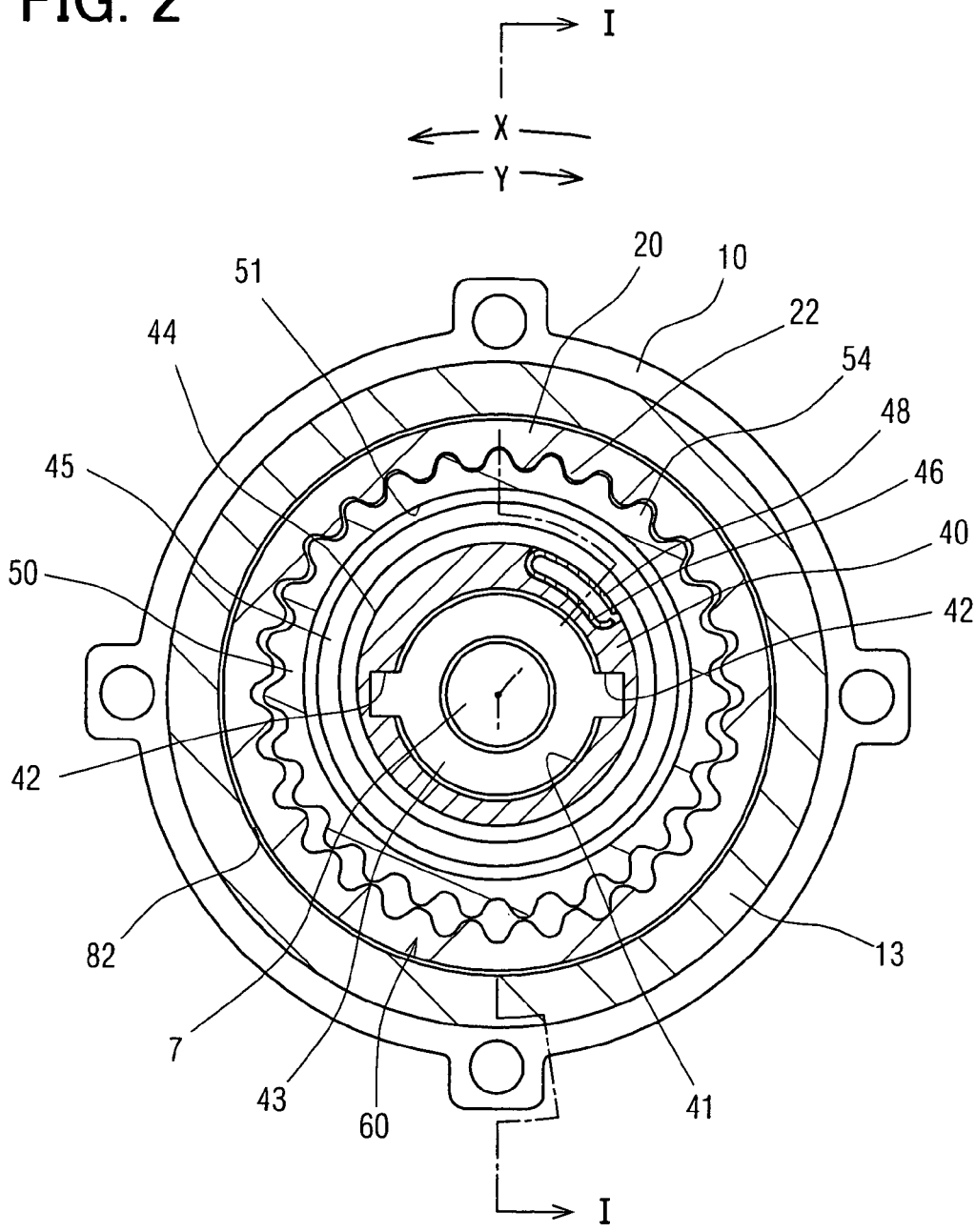
FIG. 2 is a cross sectional view taken along a line II-II in FIG. 1.

As shown in FIGS. 1 and 2, the driven-side rotor 20 is formed in cup shape, and is concentrically arranged in the sprocket 13. The one end part of the driven-side rotor 20 forms the driven-side internal gear 22 which deviates from the driving-side internal gear 14 in the axial direction. According to this embodiment, the driven-side internal gear 22 is formed in a minor diameter rather than the driving-side internal gear 14, and the number of teeth of the driven-side internal gear 22 is established less than the number of teeth of the driving-side internal gear 14.

As shown in FIG. 1, the driven-side rotor 20 has the supporting spindle part 24 coaxially connected with a camshaft 2. Since the supporting spindle part 24 is connected with the camshaft 2, the driven-side rotor 20 rotates along with the camshaft 2 while maintaining the relative rotational phase therebetween, and the drive-side rotor 20 performs relative rotation with respect to the driving-side rotor 10. Besides, in FIGS. 2 and 3, an arrow X shows an advance direction of the driven-side rotor 20 relative to the driving-side rotor 10, and an arrow Y shows a retard direction of the driven-side rotor 20 relative to the driving-side rotor 10.

Figure 3:
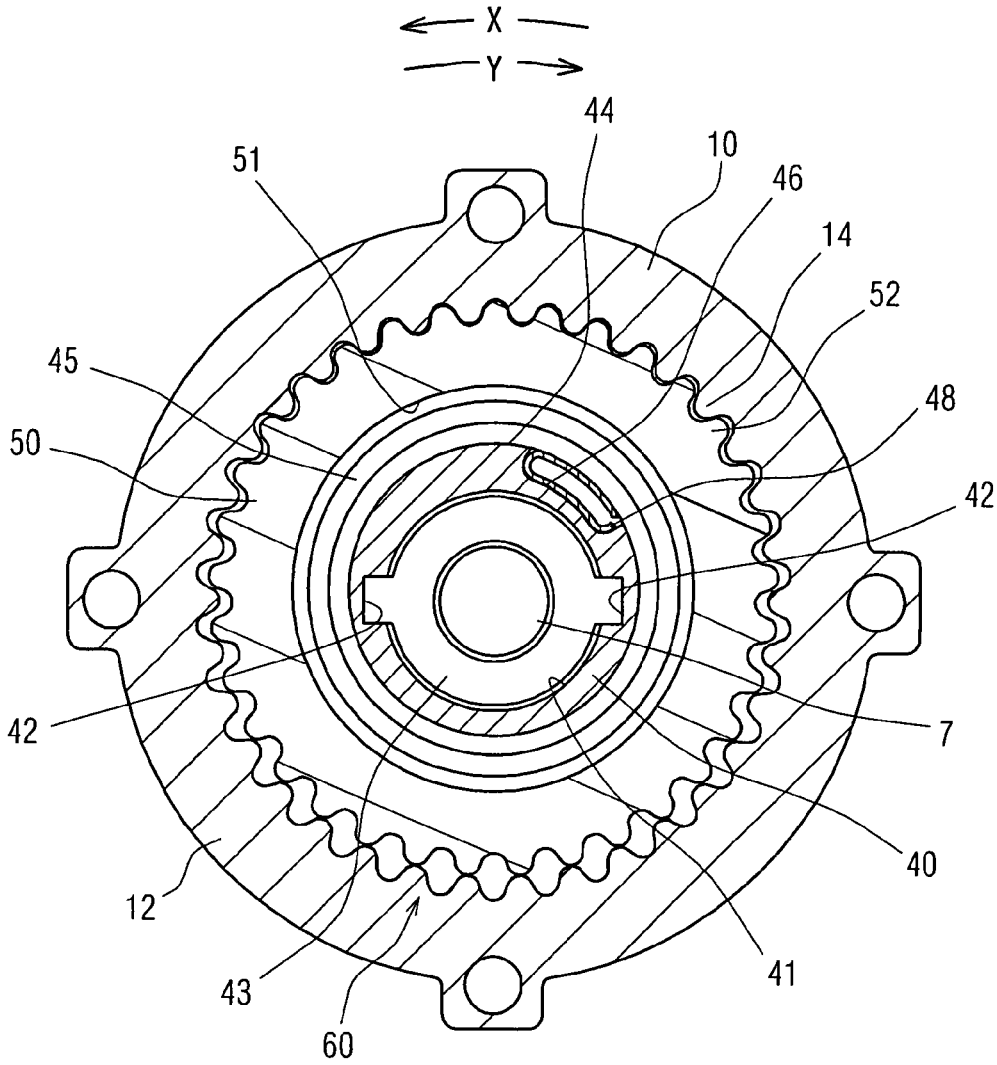
FIG. 3 is a cross sectional view taken along a line III-III in FIG. 1.

As shown in FIGS. 1 to 3, the planetary carrier 40 is formed cylindrical and forms an input part 41 through which the controlling torque is inputted from the motor shaft 7. A plurality of engaging grooves 42 is provided for the input part 41. The planetary carrier 40 is connected to the motor shaft 7 through a joint 43 which engages with the engaging grooves 42. The planetary carrier 40 rotates along with the motor shaft 7, and performs a relative rotation with respect to the rotors 10, 20.

The planetary carrier 40 is provided with an eccentric portion 44 relative to the internal gears 14, 22. The eccentric portion 44 is engaged with an inner bore 51 of the planet gear 50 through a bearing 45. The U-shaped elastic member (plate spring) 48 is accommodated in a concave portion 46 which opens to the eccentric part 44, and a restoring force of the elastic member 48 acts on an inner surface of the inner bore 51 of the planet gear 50.

The planet gear 50 is formed in a cylindrical shape with a step, and is coaxially arranged to the eccentric portion 44. That is, the planet gear 50 is eccentrically arranged with respect to the internal gears 14, 22. The planet gear 50 is provided with a driving-side external gear 52 and a driven-side external gear 54 on its large diameter portion and a small diameter portion. The gears 52, 54 respectively have the addendum circle outside of the dedendum circle. In this embodiment, the number of teeth of the driving-side external gear 52 and the driven-side external gear 54 are established less than the number of teeth of the driving-side internal gear 14, and the driven-side internal gear 22 by the same number, respectively. The number of teeth of the driven-side external gear 54 is less than the number of teeth of the driving-side external gear 52. The driving side external-gear 52 is arranged in such a manner as to engage with the driving-side internal gear 14. The driven-side external gear 54 is arranged in such a manner as to engage with the driven-side internal gear 22. The planet gear 50 rotates around a center of the eccentric portion 44 and performs a planetary motion in a rotation direction of the eccentric portion 44.

The phase adjusting mechanism 8 is provided with a planetary mechanism 60 of the differential-gear type which reduces the rotational speed of the planetary carrier 40 and transfer its rotational motion to the camshaft 2. And the phase adjusting mechanism 8 adjusts the engine phase according to the torque inputted from the torque generating system 4, and the average torque of the fluctuation torque transmitted from a camshaft 2. Besides, the fluctuation torque is a torque transmitted to the phase adjusting mechanism 8 on driving the internal combustion engine, and the average torque causes the driven-side rotor 20 to be rotated in a retard direction Y relative to the driving-side rotor 10.

When the input torque from the torque generating system 4 is held and the planet carrier 40 does not rotates relative to the driving-side rotor 10, the planet gear 50 rotates along with the rotors 10, 20 while maintaining an engagement position with the internal-gears 14 and 22. Therefore, an engine phase does not change and the valve timing is kept constant as the result.

When the input torque from the torque generating system 4 increases in the advance direction X and the planet carrier 40 performs relative rotation in the direction X to the driving-side rotor 10, the planet gear 50 performs the planetary motion, changing the engagement position with the internal gears 14, 22, whereby the driven-side rotor 20 performs relative rotation in the direction X to the driving-side rotor 10. Therefore, an engine phase is advanced, and the valve timing is also advanced as the result.

When the input torque from the torque generating system 4 increases in the direction Y and the planet carrier 40 performs relative rotation in the direction Y to the driving-side rotor 10 the planet gear 50 performs the planetary motion, changing the engagement position with the internal gears 14, 22, whereby the driven-side rotor 20 performs relative rotation in the direction Y to the driving-side rotor 10. Therefore, an engine phase is retarded, and the valve timing is also retarded as the result.

Next, the characterizing portion of the first embodiment is explained in detail.

Figure 4:
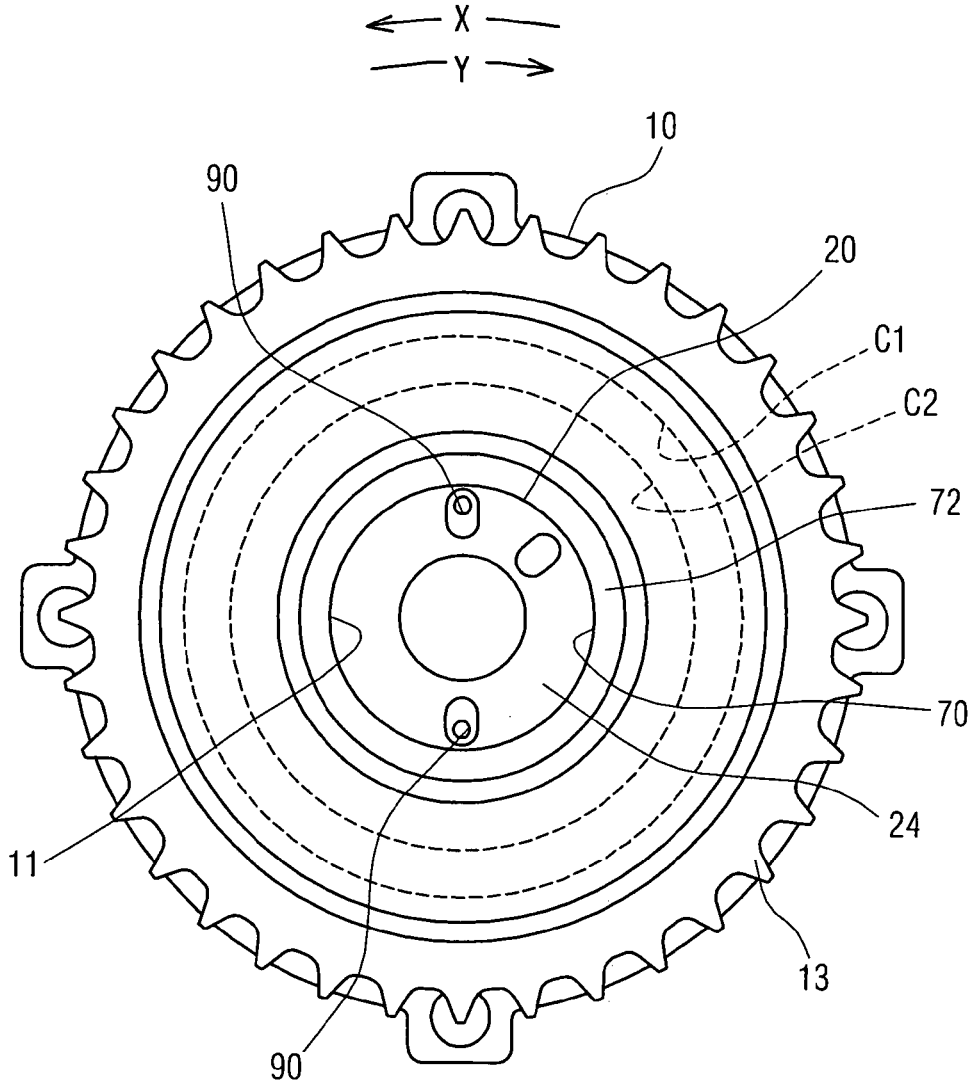
FIG. 4 is a side view along a line IV-IV in FIG. 1.

As shown in FIGS. 1 and 4, the sprocket 13 has a support opening 70. The support opening 70 opens at a side-surface 72 of the sprocket 13 and communicates with the chamber house 11. The support opening 70 is cylindrical opening of which diameter is smaller than that of the addendum circles C1, C2 of each internal-gear parts 14 and 22. The support opening 70 and the gears 14 and 22 are deviate from each other in the axial direction. In this embodiment, the support opening 70 is positioned at an opposite side of the driving-side internal gear 14 with respect to the driven-side internal gear 22.

The supporting spindle part 24 of the driven-side rotor 20 is cylindrical shape of which inner diameter is smaller than that of the addendum circles C1, C2 of each internal-gear parts 14 and 22. The support spindle part 24 and the gears 14 and 22 are deviate from each other in the axial direction. Moreover, an outer diameter of the supporting spindle part 24 is approximately the same as an outer diameter of a connoting portion 2*a* of the camshaft 2. The supporting spindle part 24 is concentrically inserted into the support opening 70, and rotatably supports the inner surface of the support opening 70 in an almost whole region in the axial direction. That is, the supporting spindle part 24 supports the support opening 70 directly from its inner circumference, whereby the relative position precision of the diameter direction between these rotors 10 and 20 is enhanced, permitting the relative rotation between rotors 10 and 20, As shown in FIG. 1, the sprocket 13 has the driving-side stepped section 74 which stepwise connects the support opening 70 and the driving-side internal gear 14 of the gear member 12. An annular stopper surface 76 is formed on the driving side stepped section 74 confronting to the chamber houses 11 in the axial direction.

The driven-side rotor 20 has a driven-side stepped section 84 which stepwise connects the supporting spindle part 24 and the driven-side internal gear 22. The driven-side stepped section 84 has an annular contact surface 86 in the axial direction. The contact surface 86 has a smaller diameter than that of the stopper surface 76, and is brought to contact with the stopper surface 76 in a relative rotational manner. That is, the contact surface 86 slidably abuts on the stopper surface 76 in the axial direction, whereby the relative position precision of the axial direction between these rotors 10 and 20 is enhanced, permitting the relative rotation between rotors 10 and 20. Besides, in the driven-side stepped section 84 of this embodiment; the recess portion 88 is formed in the outer circumference of the contact surface 86. Thereby, while the clearance 80 is formed between the recess portion 88 and the stopper surface 76, the contact part of surfaces 86 and 76 has a smaller diameter than that of the addendum circle C1 and C2.

As shown in FIGS. 1 and 2, a clearance 82 is formed between the outer circumference of the driven-side stepped section 84 and the driven-side internal gear 22, and the driving-side stepped sections 74. Thereby according to this embodiment, the radial supporting portion between the rotors 10 and 20 is limited to the engaging portion of the support opening 70 and the supporting spindle part 24, permitting the relative rotation between rotors 10 and 20.

As shown in FIGS. 1 and 4, the driven-side rotor 20 has a plurality of supply passages 90 in its circumferential direction. The supply passages penetrate the supporting spindle part 24 and the driven-side stepped section 84. The inlet port of each supply passage 90 communicates with the introductory passage 2*b* at the connecting portion 2*a* of the camshaft 2. Lubricant oil is introduced into the introductory passage 2*b* from the pump 9. The outlet of each supply passage 90 communicate with the chamber houses 11, and the lubricant oil introduced to the introductory passage 2*b* is supplied to the planetary mechanism part 60 through each supply passage 90 during driving of an internal combustion engine.

In this way, the lubricant oil supplied to the planetary mechanism part 60 flows and lubricates between the gear parts 22 and 54 and between the gear parts 14 and 52. Here, a part of lubricant oil which flows from the gears 22, 54 to the gears 14, 52 by the centrifugal force flows also into the clearance 82 around the driven-side internal gear 22. However, the lubricant in the clearance 82 hardly flows between the support opening 70 and the supporting spindle part 24.

According to the first embodiment, since the amount of the lubricant discharged from between the support opening 70 and the supporting spindle parts 24 can be reduced, it is well lubricated between the gears 22, 54 and the gears 14 and 52 and the durability of the planetary mechanism 60 is enhanced.

Moreover, as mentioned above, in the first embodiment, the relative position precision in the radial direction between the rotors 10 and 20 is enhanced by directly supporting the support opening 70 from its inner circumference by the supporting spindle part 24. Therefore, in the phase adjusting mechanism 8 which includes the planetary mechanism 60, its durability is improved and the engine phase can be changed smoothly.

In the first embodiment, since the first rotor 10 is supported by the second rotor 20 at the engaging part of the supporting opening 70 and the supporting spindle part 24 of which diameter is smaller than that of the internal gears 14, 22, 10, the frictional resistance in the engaging part can be reduced. Furthermore, since the contact portion of the surfaces 76 and 86, which defines the position between rotors 10 and 20 in the axial direction, has a small diameter than that of the internal gears 14, 22, the friction resistance in the contact part can be reduced. Hence, torque loss between the rotors 10, 20 can be reduced, and the engine phase is smoothly changed by the phase adjusting mechanism 8.

In addition, the supporting section and the contact portion between rotors 10 and 20 has a small diameter as mentioned above, the amount of surface treatment for obtaining a relative position precision can be reduced. Therefore, time and cost required for such surface treatment become reducible.

Furthermore, since the supporting spindle part 24 and the connecting portion 2*a* of the camshaft 2 has substantially the same diameter, the mechanical strength of the supporting spindle part 24 is ensured and the supply passage 90 is easily formed.

Furthermore, in addition, the planet gear 50 which receives the restoring force of the elastic member 48 is forced against the internal-gears 14 and 22, so as to firmly engage with the internal-gears 14 and 22. It is restricted by the clearance 82 that the driven-side internal gear 22 contacts with the driving-side rotor 10 by the planet gear 50 so as to produce torque loss.

Second Embodiment

Figure 5:
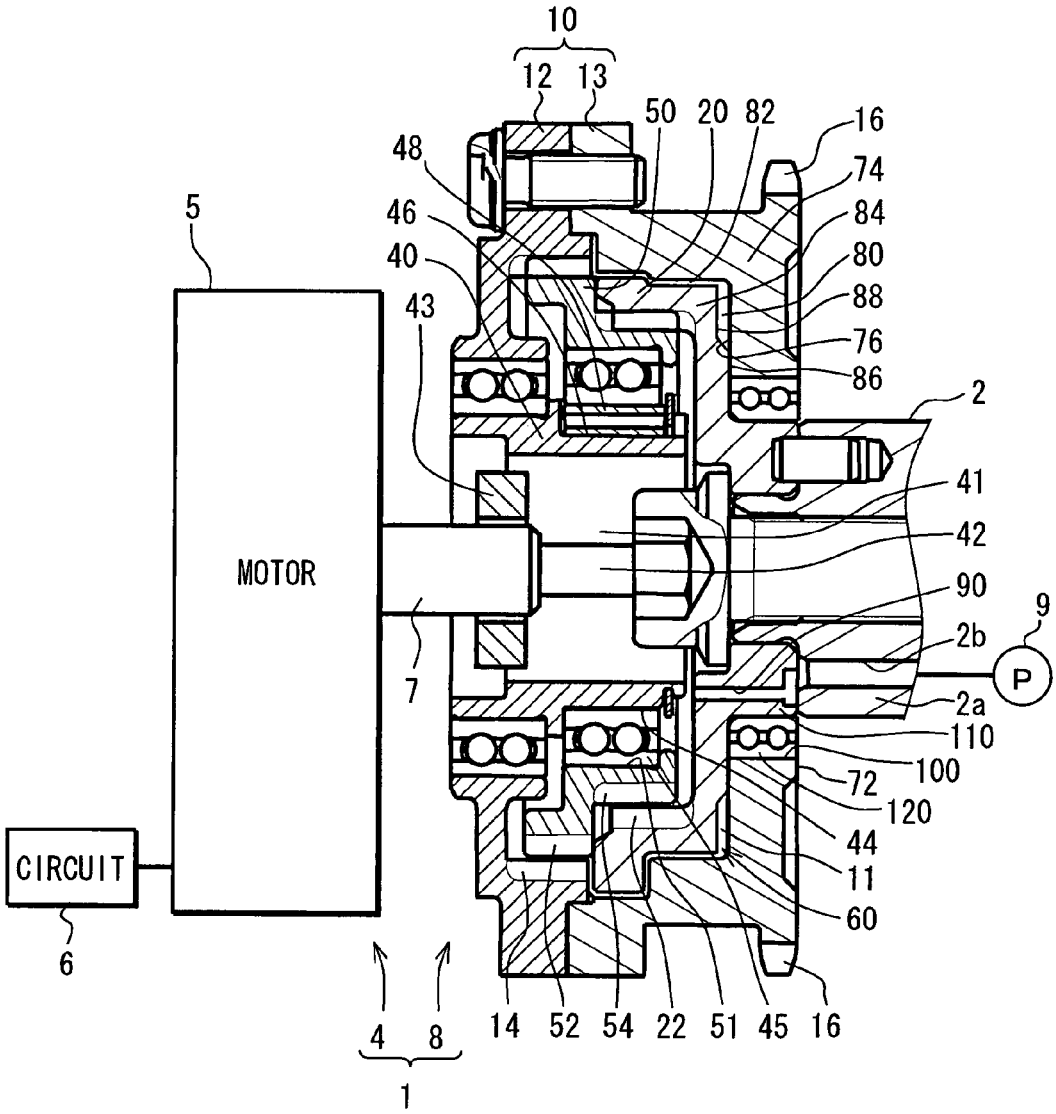
FIG. 5 is a cross sectional view showing a valve timing controller according to a second embodiment of the present invention.

As shown in FIG. 5, a second embodiment is a modification of the first embodiment. According to the second embodiment, a bearing 120 is interposed between the support opening 100 and the supporting spindle part 110. That is, the supporting spindle part 110 supports the support opening 100 through the bearing 120 from its inner circumference, whereby the relative position precision of the diameter direction between these rotors 10 and 20 is ensured, permitting the relative rotation between rotors 10 and 20,

Other Embodiments

The present invention is not limited to the embodiment mentioned above, and can be applied to various embodiments.

For example, the rotor 10 may rotate along with the camshaft 2, and the rotor 20 may rotate along with the crankshaft.

At least one of the gears 14 and 22 and corresponding gears 52, 54 may be changed into the external gear and the internal gear, respectively.

Furthermore, the gear 22 of a rotor 20 may be formed in a major thread diameter rather than the gear 14 of a rotor 10. In this case, the supporting spindle part 24,110 may be formed in a major thread diameter rather than the gear 14 and may be formed in a minor thread diameter rather than the gear 22. Moreover, the supporting spindle part 24,110 may be formed in a major diameter rather than a camshaft 2, and may form in a minor diameter rather than a camshaft 2.

In addition, a part of axial direction of the support opening 70,100 may be supported by the supporting spindle part 24,110.

In addition, the rotors 10 and 20 may contact with each other in the axial direction at a position other than the stepped sections 74 and 84. The rotors 10 and 20 may not contact with each other in the axial direction.

Furthermore, in addition, as a torque generation means which provides torque to the planetary mechanism part 60 of the phase adjusting mechanism 8, a dynamo-electric brakes and hydraulic motors, such as an electromagnetic brake or a fluid brake, can be used instead of the electric motor 5. Besides, in a case of using a dynamo-electric brake, an elastic member can be provided to the phase adjusting mechanism 8 in order to rotate the rotor 20 in the retard direction.

And the present invention is applicable also to the apparatus which adjusts the valve timing of the exhaust valve, and the apparatus which adjusts the valve timing of the intake valve and the exhaust valve.

What is claimed is:

1. A valve timing controller adjusting a valve timing of an intake valve and/or an exhaust valve of an internal combustion engine, comprising:

a first rotor having a first gear and rotating along with one of a crankshaft and a camshaft of the internal combustion engine;

a second rotor having a second gear and rotating along with the other of the crankshaft and the camshaft; and a planet gear performing a planetary motion to vary a relative rotational phase between the first rotor and the second rotor while engaging with the first gear and the second gear, wherein the first rotor has the support opening at an end surface thereof, and accommodating the second rotor therein, the second rotor has a supporting spindle part which supports the support opening from an inner circumference thereof, an inner diameter of the supporting opening and an outer diameter of the supporting spindle part are smaller than an outer diameter of the second gear which engages the planet gear with a lubricant, and the supporting opening and the supporting spindle part are positioned at a place which deviates from the second gear in an axial direction thereof.

2. A valve timing controller according to claim 1, wherein the first rotor has a first stepped section which stepwise connects the first gear and the support opening, and the second rotor has the second stepped section which stepwise connects the second gear and the supporting spindle part.

3. A valve timing controller according to claim 2, wherein the second stepped section is in contact with the first stepped section in an axial direction.

4. A valve timing controller according to claim 1, wherein the supporting spindle part is connected to the camshaft to rotate together, and the lubricant is supplied to the second gear through a passage provided in the camshaft and the supporting spindle part.

5. A valve timing controller according to claim 4, wherein the supporting spindle part has substantially the same diameter as a connecting portion of the camshaft.

6. A valve timing controller according to claim 1, wherein the supporting spindle part directly supports the support opening.

7. A valve timing controller according to claim 1, wherein the supporting spindle part supports the support opening through a bearing.

* * * * *